US005429449A

United States Patent [19]

Baatz

[11] Patent Number: 5,429,449

[45] Date of Patent: Jul. 4, 1995

[54] RUBBER ADAPTOR FOR HIGHWAY GUARDRAIL

[76] Inventor: Guenter A. Baatz, 33 Pioneer Tower Road, Kitchener, Ontario, Canada, N2G 3W6

[21] Appl. No.: 245,569

[22] Filed: May 18, 1994

[51] Int. Cl.[6] ..... E01F 15/00

[52] U.S. Cl. ..... 404/6; 256/13.1

[58] Field of Search ..... 404/6, 8; 256/13.1

[56] References Cited

U.S. PATENT DOCUMENTS

| | | | |
|---|---|---|---|
| 2,843,074 | 7/1958 | Norman . | |
| 3,704,861 | 12/1972 | Glaesener | 256/13.1 |
| 3,825,229 | 7/1974 | Bartlett et al. . | |
| 4,000,882 | 1/1977 | Penton | 404/6 X |
| 4,028,288 | 6/1977 | Turner . | |
| 4,222,522 | 9/1980 | Matteo, Sr. . | |
| 5,336,016 | 8/1994 | Baatz | 404/6 |

FOREIGN PATENT DOCUMENTS

| | | | |
|---|---|---|---|
| 0178367 | 1/1985 | European Pat. Off. . | |
| 437414 | 7/1991 | European Pat. Off. | 256/13.1 |
| 2460365 | 6/1979 | France . | |
| 4116317 | 11/1992 | Germany | 256/13.1 |
| 4135164 | 1/1993 | Germany . | |
| 618488 | 7/1980 | Switzerland . | |

*Primary Examiner*—William P. Neuder

*Attorney, Agent, or Firm*—Riches, McKenzie & Herbert

[57] ABSTRACT

This invention relates to a method of manufacturing a solid rubber adaptor for converting an existing sheet metal highway barrier, said barrier preferably comprising an elongate horizontal guardrail of uniform transverse crossection connected to supporting posts spaced along the length of the guardrail, the guardrail having a roadside contoured surface and upper and lower edges, said adaptor comprising an elongate channel of uniform transverse crossection having an outer curbside contoured surface mating the contoured surface of the guardrail, the channel including a central web portion with an upper flange and a lower flange outwardly extending therefrom, the web portion having a thickness greater than the thickness of the flanges, the flanges each having outer ends with opposing return edge bead means for resiliently engaging the edges of the guardrail, said method comprising the steps of: mixing and knead melting a mixture of: 80 to 90 percent by weight particles of recycled waste rubber; 10 to 20 percent by weight virgin rubber; and an accelerator composition; forming the mixture to a selected adaptor configuration thus defining an adaptor; curing the mixture within a chamber at a temperature of 350° C. to 400° C. for a period of time from 3 to 5 hours; and removing the cured barrier from the chamber.

19 Claims, 1 Drawing Sheet

RUBBER ADAPTOR FOR HIGHWAY GUARDRAIL

FIELD OF THE INVENTION

The invention relates to a solid rubber highway guardrail adapter which has an interior surface shaped to snap-lock over the exterior of an existing sheet metal highway guardrail.

BACKGROUND OF THE INVENTION

Conventional guardrail assemblies installed along highways typically have at least one horizontal guardrail that is supported at spaced locations by vertical posts anchored in the ground. Generally the guardrail sections are heavy gauge sheet metal formed into a W-shaped corrugated section. Guardrails are constructed of individual sections joined in end to end relationship and overlapping at the vertical posts where they are connected with bolts. The corrugation of the W shape imparts rigidity and strength to the guardrail while being relatively simple to fabricate.

Metallic guardrails are specificly designed to yield when impacted upon by a colliding vehicle. The deformation of the sheet metal guardrail serves to decelerate the vehicle and guide the vehicle away from hazards such as slopes, signs or oncoming traffic. Increasingly however the cost of maintaining sheet metal guardrails after impact has created a demand for a flexible guardrail which can decelerate impacting vehicles while reducing the cost of maintenance by remaining substantially intact after impact.

In addition metallic guardrails made of steel are subject to rapid deterioration due to corrosion from constant exposure to precipitation, salt and stones. In order to prevent deterioration of the guardrails, the steel surfaces are generally galvanized with zinc. However, flying stones and other debris thrown against the guardrail by passing vehicles or high winds can cause pitting of the surface and permit corrosion to rapidly deteriorate the exposed the steel surfaces. Therefore highway guardrails are often unsightly even if not particularly damaged by impacting vehicles.

Especially in areas such as curves or high traffic concentrations, maintenance of guardrails becomes an expensive and time consuming process. On busy highways and around curves on entrance and exit ramps constant maintenance may be required in order to keep the metal guardrails in safe and operable condition.

The prior art therefore includes a number of covers which are attached to existing guardrails to offer a resilient surface and to rehabilitate the appearance of the deteriorated guardrails. Examples of rubber covers which are bolted to or integrally formed onto sheet metal guardrails are disclosed in French patent publication no. 2460365 published Jan. 23, 1981—Societe Civile D'Equipement Public and Swiss patent No. 618488 dated Jul. 31, 1980.

A significant disadvantage of both such prior art devices is that the rubber cover closely follows the contours of the underlying sheet metal guardrail. The relatively thin cover of rubber is insufficient to absorb the impact of a vehicle colliding with the barrier at normal highway speeds. After such a collisions both the rubber cover and sheet metal guardrail must be completely replaced. The relatively thin cover layer of rubber would simply peel off due to the force of a vehicle scraping along the composite guardrail. Therefore, thin layers of rubber covers are ineffectual in preventing damage to the metal guardrail, are insufficiently flexible to prevent damage to the impacting vehicle and appear to merely represent an attempt to rehabilitate the appearance of the sheet metal guardrail.

German patent No. DE 4135164A1 dated Jan. 28, 1993 discloses a flexible rubber guardrail cover which is relatively thin such that it may be coiled in cylindrical rolls. The guardrail cover rebounds to a C shape when uncoiled during installation to wrap around an existing guardrail. Such a cover is insignificant in protecting the guardrail structure and would merely peel off when impacted by a colliding vehicle. The primary purpose of such a thin cover would appear to be economical and rapid rehabilitation of the appearance of an unsightly guardrail.

Therefore it is desirable to produce a guardrail adaptor which may be easily snap-fit over an existing guardrail while also providing a substantial degree of protection from impacting vehicles for the guardrail.

It is also desirable to produce a resilient guardrail adaptor which will not simply peel off the guardrail when impacted by a colliding vehicle.

The danger of dispersing guardrail materials over the travelled surface of a busy highway presents significant disadvantages since such debris may cause additional accidents and delays on the highway. It is desirable therefore that, on impact with a colliding vehicle, the sheet metal guardrail and the rubber adaptor remains substantially intact.

SUMMARY OF THE INVENTION

The invention overcomes the disadvantages of the prior art in a novel manner in the provision of a solid rubber adaptor for converting an existing highway barrier, said barrier comprising an elongate horizontal guardrail of uniform transverse crossection connected to supporting posts spaced along the length of the guardrail, the guardrail having a roadside contoured surface and upper and lower edges, said adaptor preferably comprising an elongate channel of uniform transverse crossection having an outer curbside contoured surface mating the contoured surface of the guardrail, the channel including a central web portion with an upper flange and a lower flange outwardly extending therefrom, the web portion having a thickness greater than the thickness of the flanges, the flanges each having outer ends with opposing return edge bead means for resiliently engaging the edges of the guardrail.

Also provided is a method of manufacturing such a solid rubber adaptor comprising the steps of: mixing and knead melting a mixture of: 80 to 90 percent by weight particles of recycled waste rubber; 10 to 20 percent by weight virgin rubber; and an accelerator composition; forming the mixture to a selected adaptor configuration thus defining an adaptor; curing the mixture within a chamber at a temperature of 350° C. to 400° C. for a period of time from 3 to 5 hours; and removing the cured barrier from the chamber.

The invention therefore overcomes the disadvantage of the prior art in a design wherein the web has a thickness greater than the thickness of the flanges. Preferably the web has a thickness which is greater than one half the height of the web in order to provide a substantial mass of rubber. The increased mass provides an advantage over the prior art in that the sheet metal guardrail is protected from impacting vehicles to a substantially greater degree and the adaptor itself is stiff enough to prevent the adaptor from simply peeling off of the metal guardrail during impact.

Since the mixture which forms the solid rubber adaptor is approximately 85% by weight particles of recycled waste rubber with 15% by weight virgin rubber the cost of the increased thickness is relatively small. In fact the garbage disposal and fire hazard risks involved is disposing of waste vehicular tires are such that many government agencies are actively investigating means by which such tires can be recycled or reused. It is fitting that highway departments provide a demand for recyled vehicular tires and accordingly such government agencies are actively involved in using recycled tires for asphalt mixtures and have created a demand for recycled rubber vehicular barriers.

A distinct advantage of the invention is that the entire adaptor may itself be recycled if deteriorated or damaged due to its homogeneous composition. No reinforcing or inserts are required and therefore recycling is very simple.

In alternative embodiments the adaptor includes extended flanges which butt up against support posts for additional resistance to impact. As a result the forces of an impacting vehicle may be transferred directly by the rubber adaptor to the support posts rather than depending entirely upon the sheet metal guardrail attachment to the support posts for conveying impact forces.

In a further embodiment the adaptor may include bolt holes in the upper and lower flanges whereby an elongate bolt may clamp the channel shaped adaptor over the sheet metal guardrail. Bolts may be spaced along the span of the guardrail and may additionally connect to the support posts. As a result of the added thickness of the adaptor and clamping bolt action, the rubber adaptor is securely attached to the metal guardrail such that it will not become disengaged during impact. A disengaged rubber bumper or debris fragments could extend across the travelled surface of the highway impeding traffic and potentially causing additional accidents.

Further aspects of the invention will become apparent upon review of the following detailed description.

BRIEF DESCRIPTION OF THE DRAWINGS

In order that the invention may be readily understood, a preferred embodiment of the invention will be described by way of example with reference to the accompanying drawings in which.

DETAILED DESCRIPTION OF PREFERRED EMBODIMENTS OF THE INVENTION

Figure 1:
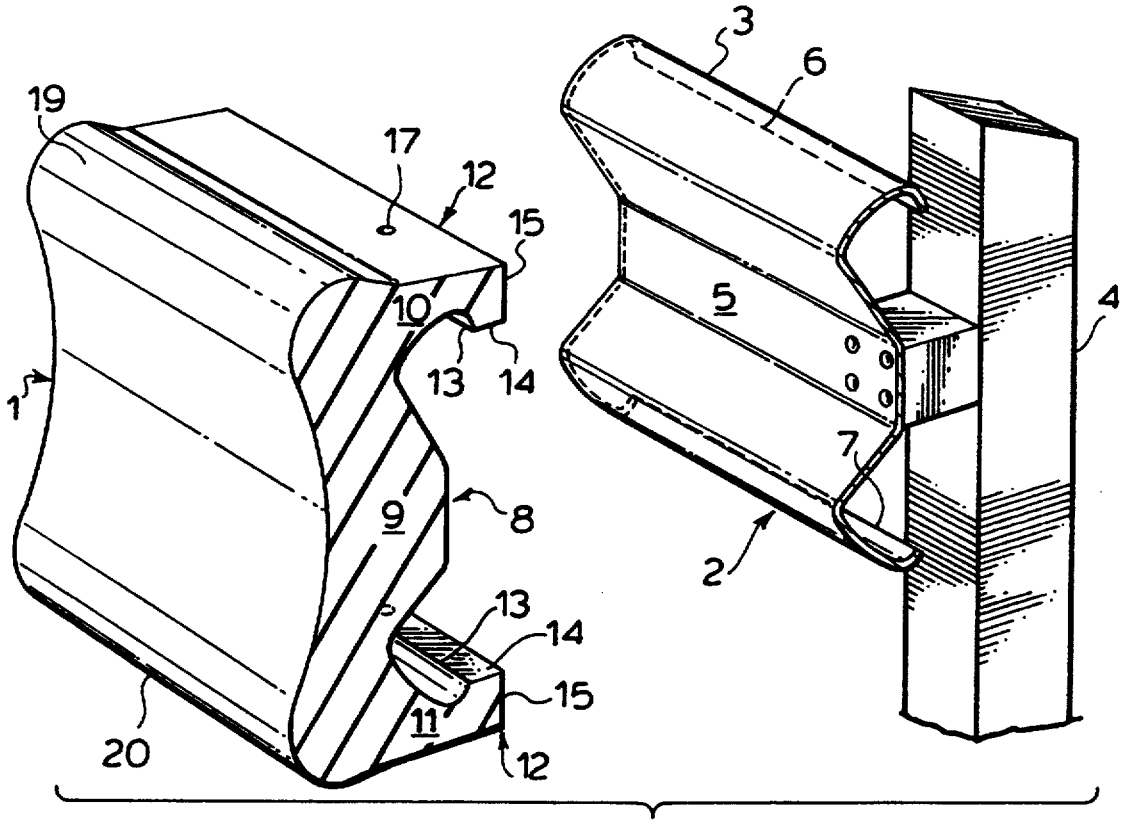
FIG. 1 is an exploded perspective view of a solid rubber adapter and an existing highway guardrail.
Figure 2:
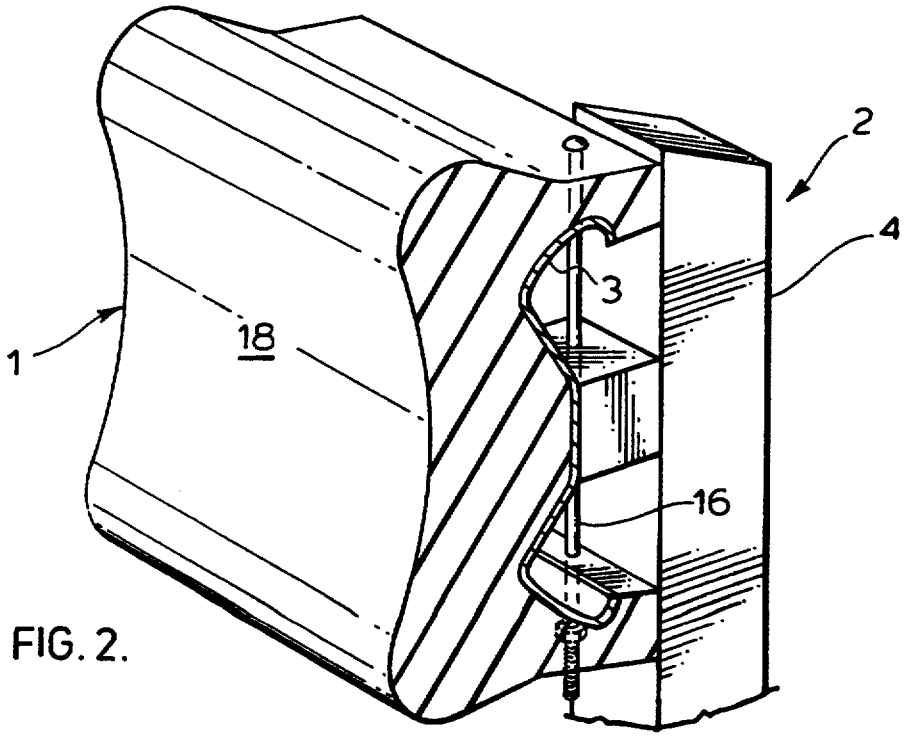
FIG. 2 is a perspective view of the adapter assembled on the guardrail.

FIG. 1 illustrates a conventional highway barrier 2 to the right, and to the left a solid rubber adaptor 1 which is snap-fit to the horizontal metal guardrail 3. FIG. 2 illustrates the assembled condition with an optional vertical bolt 16 securing the adaptor 1 to the highway barrier 2.

The rubber adaptor 1 is preferably extruded of a homogeneous rubber mixture the major portion of which comprises recycled waste vehicular tire fragments.

The adaptor 1 provides an impact cushioning surface which decelerates colliding vehicles, and protects the sheet metal guardrail 3 from extensive damage. The adaptor 1 will not simply peel off on impact due to mechanical connection with bolts 16, the secure engagement of the adaptor flanges 10, and 11 resiliently clamping around the guardrail 3, and the relatively thick web 9 as compared to prior art devices. The substantial size and stiffness of the adaptor 1 and the optional securing of the adaptor 1 to the guardrail 3 with bolts 16 ensure that the adaptor 1 remains in place and does not become detached on impact causing further hazards to automobile traffic.

The rubber adaptor 1 itself is moulded or extruded of a homogeneous mixture and if damaged or deteriorated in any way it can be easily removed and recycled for further use.

The adaptor 1 is ideally suited to retrofit existing guardrails 3 where repeated collisions have created the need for a redesigned guardrail 3 to minimize maintenance costs. In many cases as well, the extremely high volume of traffic in certain highway areas make it undesirable to shut down highway lanes in order to maintain the guardrail 3 on a periodic basis. For these reasons the rubber guardrail adaptors 1 minimize maintenance and down time in busy highway areas or in areas where repeated maintenance is required due to collisions such as on curves, exits, or entrances.

The invention provides further advantages over the prior art in flanges 10 and 11 which extend to butt up against the vertical post 4 of an existing barrier 2. In this manner the adaptor 1 itself is used as a horizontal structural member to convey forces directly to the vertical posts 4 rather than depending upon the sheet metal guardrail 3 to convey all forces of impact. Therefore not only the adaptor 1 protects the sheet metal guardrail 3 from damage but it also aids in conveying impact forces as a composite beam with the steel guardrail 3 directly to the vertical posts 4.

To ensure that the adaptor remains engaged on the guardrail 3 and to further enhance the composite action of the adaptor 1 and guardrail 3 combination, vertical bolts 16 may be optionally used to span between the flanges 10 and 11 to clamp the flanges 10 and 11 to the guardrail 3. In order to dislodge the adaptor 1 from the guardrail 3 during a collision, it is first necessary to overcome the resistant forces of the bolts 16 in the flanges 10 and 11.

A detailed description of the adaptor 1, method of manufacture and its use is presented below.

With reference to FIG. 1, a solid rubber adaptor 1 is provided for converting an existing sheet metal highway barrier 2 to a resilient impact absorbing composite rubber/metal core barrier. The existing barrier 2 comprises an elongate horizontal sheet metal guardrail 3. The metal guardrail 3, as is conventional, has a uniform transverse cross section. In general use in North America guardrails are a W-shaped galvanized heavy gauge section roll-formed with rounded upper and lower edges 6 and 7.

Such guardrails 3 are connected to supporting posts 4 which are spaced along the length of the guardrail 3. In median divider applications the post 4 may carry guardrails 3 and adaptors 1 on two opposing sides. The guardrail 3 has a contoured surface 5 and upper and lower edges 6 and 7. The contoured surface 5 of the guardrail imparts substantial strength the heavy gauge sheet metal structure and provides a central flat portion with bolt holes for securing the guardrail 3 to the post 4.

Turning to the adaptor 1, the adaptor 1 comprises an elongate channel of uniform crossection. Advantageously, the uniform channel shape may be formed by extrusion or alternatively in an elongate mold. The adaptor 1 has an outer curb side contoured surface 8 which mates the roadside contoured surface of the guardrail 3.

The adaptor channel 1 includes a central web portion 9 with an upper flange 10 and a lower flange 11 outwardly extending from the upper and lower portions of the web 9. The web 9 has a thickness substantially greater than the thickness of the flanges 10 and 11 in order to provide enhanced cushioning effect and to protect the metal guardrail 3 from damage from impacting vehicles. The flanges 10 and 11 each have outer ends 12 with opposing return edge beads 13 for resiliently engaging the edges 6 and 7 of the guardrail 3, as shown in the assembled view of FIG. 2. In order to facilitate the snap locking engagement of the adaptor 1 on the guardrail 3, the edge beads 13 include lead-in planar tapered guide surfaces 14. During installation, the lead-in guide surfaces 14 slide on the guardrail 3 flexibly forcing the flanges 10 and 11 to open and then snap-lock around the edges 6 and 7 of the guardrail 3.

In order to facilitate the flexible snap locking of the adaptor 1 on the guardrail 3, the thickness of the flanges 10 and 11 are appreciably less than the thickness of the web 9. Preferably, the web 9 has a thickness which is greater than one half the height of the web 9. Prior art adaptors include very thin rubber layers which simply peel off the guardrail 3, on impact with colliding vehicles, and disperse debris which pose further risk to other vehicles travelling on the highway. By providing a relatively thick web 9, the adaptor 1 in accordance with the invention is relatively stiff and remains engaged on the guardrail 3 during and after impact.

To enhance the load bearing capacity of the guardrail 3 and prevent disengagement of the adaptor 1 from the guardrail 3, preferably each flange end 12 includes a vertical face 15. The vertical faces 15 form post abutment means for engaging the support posts 4 of the barrier as shown in FIG. 2. By bearing the adaptor 1 directly upon the support posts 4, the forces of an impacting vehicle colliding with the adaptor 1 are not entirely carried by the sheet metal guardrail 3, but rather forces are conveyed by the web 9 and flanges 10 and 11 of the adaptor 1 directly to the support posts 4.

To further enhance the load carrying capacity of the composite adaptor 1 and guardrail 3, vertical bolts 16 as shown in FIG. 2, are provided. Each flange 10 and 11 includes a plurality of longitudinally spaced bolt holes 17. Bolts 16 are used to span between the flanges 10 and 11, and when tightened with nuts, the bolts 16 clamp the flanges 10 and 11 to the guardrail 3. Although the bolt 16 shown in FIG. 2 secures the flanges 10 and 11 to the supporting posts 4 it will be understood that to further secure the adaptor 1 to the guardrail 3, a longitudinal series of bolt holes 17 between the spaced apart posts 4 may be used and a series of bolts 16 used to clamp the adaptor 1 securely on the guardrail 3 between the vertical posts 4.

With reference to FIG. 2, it is preferrable to form the inward surface 18 which faces the roadway traffic, as a concave surface. A concave surface 18 prevents automobiles from riding over the guardrail 3 on impact since the concave surface 18 resists upward movement and envelopes the side of the impacting vehicle. In order to prevent extensive damage to a vehicle and the guardrail 3 as well as to facilitate extrusion or moulding the upper surface of the upper flange 10 and the lower surface of the lower flange 11 are also formed in a concave manner with the inward surface of the web 9 and upper surface of the upper flange 10 arcuately merging together to form a convex inward upper ridge 19. As well, the inward surface of the web 9 and lower surface of the lower flange 11 arcuately merge together to define a convex inward lower ridge 20. The upper and lower ridges 19 and 20 provide a significant mass of rubber on the corners of the adaptor 1 to resist impact and prevent damage to the guardrail 3.

Since recycled tire rubber is increasingly available and many government bodies including highway departments actively encourage the use of recycled tires to prevent a significant waste problem, preferably the adaptor 1 comprises 85% recycled tire rubber and 15% virgin rubber although the amounts can be varied between 80 to 90% recycled rubber and 10 to 20% virgin rubber. A mixture is made with the rubber and an accelerator composition which is mixed and knead melted then formed into the selected adaptor configuration by extrusion or forming in a mould. After forming in the required configuration, the mixture is cured within a chamber at a temperature of 350° C. to 400° C. for a period of three to five hours, preferably at 375° C. for four hours. After curing, the adaptor is removed from the chamber and the process may be continued indefinitely to provide further adaptors.

It will be understood from the above description that if an existing installed rubber adaptor is damaged during collision or deteriorates in any way, the damaged adaptor may simply be removed and replaced. The damaged adaptor may be ground up in the manner similar to grinding of waste tires and may be reused indefinitely.

Therefore the solid rubber adaptor 1 provides not only a means for recycling waste tires but the adaptor 1 itself may be recycled indefinitely. Therefore, the waste tires are effectively removed from functions which would contribute to environmental pollution.

As described above, the adaptor 1 according to the invention provides significant advances over the prior art. The abutting faces 15 of the adaptor significantly increase the load bearing capacity of the guardrail 3 in composition with the adaptor 1 installed on it. The use of bolts 16 further clamps the adaptor 1 onto the guardrail 3, prevents disengagement and adds to the composite beam action of the assembly. Prior art rubber barriers are relatively thin and are prone to merely peel off during impact presenting further risks to adjacent traffic.

It will also be understood that use of bolt 16 is optional and the adaptor 1, due to its resilient snap locking action, remains engaged on the sheet metal barrier 3 during impact even without bolts 16. The relatively thick configuration of the web 9 adds signficant rigidity to the adaptor 1 and the action of the edge beads 13 wrapping around the upper and lower edges 6 and 7 of the sheet metal guardrail 3 ensure that the adaptor 1 and guardrail 3 remain engaged during impact with a colliding vehicle. The adaptor 1 may be easily installed without disrupting traffic due its resilient snap-locking capability. The resilient snap-locking feature renders the adaptor ideally suited for rapidly reconditioning rusted or dented guardrails 3, for rapidly converting guardrails in heavy traffic areas and may be used as a temporary safety feature when roads are converted for use during automobile or bicycle races.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

The embodiments of the invention in which an exclusive property or privilege is claimed are defined as follows:

1. A solid rubber adaptor for converting an existing highway barrier, said barrier comprising an elongate horizontal guardrail of uniform transverse crossection connected to supporting posts spaced along the length of the guardrail, the guardrail having a roadside contoured surface and upper and lower edges, said adaptor comprising an elongate channel of uniform transverse crossection having an outer curbside contoured surface mating the contoured surface of the guardrail, the channel including a central web portion and integral clamping means for resiliently engaging the edges of the guardrail.

2. An adaptor according to claim 1 wherein the clamping means comprise an upper flange and a lower flange outwardly extending from the web.

3. An adaptor according to claim 2 wherein the flanges each have outer ends with opposing return edge bead means.

4. An adaptor according to claim 3 wherein the edge bead means comprise planar tapered guide surfaces.

5. An adaptor according to claim 2 wherein the web portion have a thickness greater than the thickness of the flanges.

6. An adaptor according to claim 1 wherein the web has a thickness greater than one half the height of the web.

7. An adaptor according to claim 2 wherein the flange ends include post abutment means for engaging the support posts of the barrier.

8. A solid rubber adaptor for converting an existing highway barrier, said barrier comprising an elongate horizontal guardrail of uniform transverse crossection connected to supporting posts spaced along the length of the guardrail, the guardrail having a roadside contoured surface and upper and lower edges, said adaptor comprising an elongate channel of uniform transverse crossection having an outer curbside contoured surface mating the contoured surface of the guardrail, the channel including a central web portion and integral clamping means for resiliently engaging the edges of the guardrail, said clamping means comprising an upper flange and a lower flange outwardly extending from the web and each flange including a plurality of longitudinally spaced bolt holes, said adaptor further comprising bolt means for spanning between and clamping the flanges to the guardrail.

9. An adaptor according to claim 8 including bolt means for spanning between the flanges and securing the flanges to said supporting posts.

10. An adaptor according to claim 8 wherein an inward surface of the web is concave.

11. An adaptor according to claim 10 wherein an upper surface of the upper flange and a lower surface of the lower flange are concave.

12. An adaptor according to claim 11 wherein the inward surface of the web and upper surface of the upper flange arcuately merge together thereby defining a convex inward upper ridge.

13. An adaptor according to claim 12 wherein the inward surface of the web and lower surface of the lower flange arcuately merge together thereby defining a convex inward lower ridge.

14. An adaptor according to claim 8 comprising 85% by weight recycled tire rubber and 15% by weight virgin rubber.

15. An adaptor according to claim 8 wherein the flanges each have outer ends with opposing return edge bead means.

16. An adaptor according to claim 8 wherein the edge bead means comprise planar tapered guide surfaces.

17. An adaptor according to claim 8 wherein the web portion have a thickness greater than the thickness of the flanges.

18. An adaptor according to claim 8 wherein the web has a thickness greater than one half the height of the web.

19. An adaptor according to claim 8 wherein the flange ends include post abutment means for engaging the support posts of the barrier.

* * * * *